US007876217B2

(12) United States Patent
Laackmann et al.

(10) Patent No.: US 7,876,217 B2
(45) Date of Patent: Jan. 25, 2011

(54) APPARATUS AND METHOD FOR SECURE SENSING

(75) Inventors: Peter Laackmann, Munich (DE); Marcus Janke, Munich (DE)

(73) Assignee: Infineon Technologies AG, Neubiberg (DE)

( * ) Notice: Subject to any disclaimer, the term of this patent is extended or adjusted under 35 U.S.C. 154(b) by 314 days.

(21) Appl. No.: 12/032,019

(22) Filed: Feb. 15, 2008

(65) Prior Publication Data

US 2009/0207016 A1 Aug. 20, 2009

(51) Int. Cl.
*G08B 21/00* (2006.01)

(52) U.S. Cl. ..... 340/540; 340/438

(58) Field of Classification Search ..... 340/438, 340/449, 456, 464, 465, 475, 480, 540; 74/335, 74/336 R, 473.23, 473.33; 180/336; 73/105; 318/624

See application file for complete search history.

(56) References Cited

U.S. PATENT DOCUMENTS

| | | | | |
|---|---|---|---|---|
| 6,639,375 | B2 * | 10/2003 | Paris | 318/624 |
| 6,923,083 | B2 * | 8/2005 | Fujinuma | 74/473.33 |
| 7,107,868 | B2 * | 9/2006 | Yone | 74/335 |
| 2005/0274563 | A1 * | 12/2005 | Ahnafield | 180/336 |
| 2009/0102643 | A1 * | 4/2009 | Haid | 340/540 |

* cited by examiner

*Primary Examiner*—Van T. Trieu
(74) *Attorney, Agent, or Firm*—Dickstein Shapiro LLP

(57) ABSTRACT

An apparatus including a sensor configured to sense a physical quantity, an actuator configured to manipulate the physical quantity in a predefined manner, and a detection circuit configured to output an alarm signal in case the sensor does not react to the manipulation of the physical quantity in an expected way.

16 Claims, 3 Drawing Sheets

APPARATUS AND METHOD FOR SECURE SENSING

BACKGROUND

Embodiments of the present invention relate to sensor systems and, in particular, to secure sensor systems with respect to a recognition of manipulations and/or malfunctions of a sensor.

An increasing number of sensors are employed to automate controllers in, for example, airplanes, cars or buildings. Examplarily, speeds in cars can be controlled by distance measuring or airplane steering can be automated. In some applications, authenticity, integrity and privacy of data from sensors is required to ensure the security of the entire automation.

These requirements may be achieved by integrating sensor chips and encryption chips, for example in a multi-chip package. This, however, does not prevent a manipulation of the physical measurement conditions or a malfunction of the sensor.

SUMMARY

Embodiments of the present invention provide an apparatus including a sensor configured to sense a physical quantity, an actuator configured to manipulate the physical quantity in a predefined manner and a detection circuit configured to output an alarm signal in case the sensor does not react to the manipulation of the physical quantity in an expected way.

Further embodiments of the present invention provide a method comprising sensing a physical quantity, manipulating the physical quantity in a predefined manner and outputting an alarm signal in case the manipulation of the physical quantity is not sensed in an expected way.

BRIEF DESCRIPTION OF THE FIGURES

Embodiments of the present invention will be detailed subsequently referring to the appended drawings, in which.

DETAILED DESCRIPTION OF THE INVENTION

Figure 1:
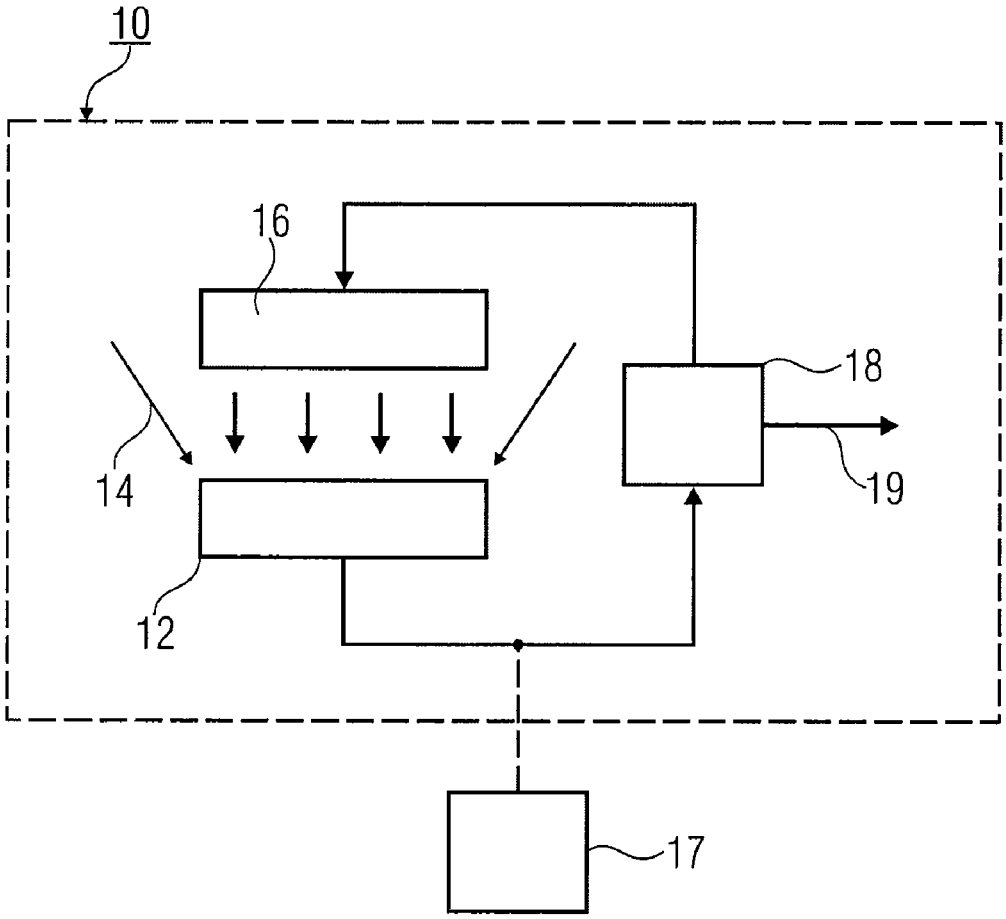
FIG. 1 shows a schematic log diagram of a secure sensor apparatus according to an embodiment of the present invention.

In the following, functional elements having the same effect in various embodiments are indicated by same reference numerals in the figures and thus descriptions of these functional elements in the various embodiments described below are mutually interchangeable.

FIG. 1 shows a schematic block diagram of a secure sensor apparatus 10 according to an embodiment of the present invention.

The apparatus 10 comprises a sensor or a sensor element 12 configured to sense a physical quantity 14. Further, the apparatus 10 comprises an actuator 16 configured to manipulate the physical quantity in a predefined manner. The sensor 12 is coupled to a detection circuit 18 which is configured to output an alarm signal 19 in case the sensor 12 does not react to the manipulation of the physical quantity 14 in an expected way.

As indicated in FIG. 1, the sensor 12 may be additionally coupled to a data processor unit 17 which further processes sensor output data delivered by the sensor 12. However, the sensor 12 and the data processor unit 17 may also operate independently from each other.

The sensor 12, may be a measuring sensor or sensing element detecting certain physical or chemical characteristics, such as, for example, heat, radiation, temperature, humidity, pressure, sound, brightness or acceleration and/or material qualities of its surroundings, in a qualitative or, as measuring quantity, quantitative manner. These quantities are detected by means of physical or chemical effects and converted into processable quantities, such as electrical signals to be output in an analogue or digital manner.

The sensor 12 and/or the actuator 16 may, for example, be implemented as a micro-electromechanical or electromechanical sensor and/or actuator, respectively. Such a micro-electromechanical sensor/actuator may comprise a combination of a mechanical element which serves as a sensor element and/or actuator element, and an electronical circuit including electrical interaction with mechanical deformation and/or motion of the mechanical element. The mechanical element and the electronical circuit may both be integrated on a substrate and/or chip.

The actuator 16 and the sensor 12 represent counterparts to each other in the sense that the actuator 16 manipulates the physical quantity to be measured by the sensor 12. The actuator 16 may be an actuating mechanism translating an electrical signal to mechanical, light, sound or temperature power, to name just a few. Such actuators are, for example, light-emitting actuators, micro-fluidic actuators, bimetal actuators, hydraulics or pneumatic actuators, electrochemical actuators, piezo-actuators, magnetostrictive actuators, rheological actuators, shape-memory alloys or chemical actuators.

The detection circuit 18 may be configured to operate on an analogue or digital sensor output signal. If the latter is analogue, the detection circuit 18 may convert the analogue sensor output signal from the sensor 12 into a digital sensor signal. Also, the detection circuit 18 may processes digital actuator signals for the actuator 16 to form, for example, an analogue drive signal for the actuator 16. Independent from the specific domain, i.e. analogue or digital, the detection circuit 18 checks whether the sensor 12 does react to the manipulation of the physical quantity in an expected way. This check can be done in various ways. For example, the sensor output signal could be compared to a predefined threshold during a test phase. Additionally, a difference signal between a drive signal for the actuator and the sensor output signal could be formed and compared to a threshold.

According to embodiments of the present invention, the sensor apparatus 10 may be implemented both as a single-chip module (SCM) or a so-called multichip module (MCM). In case of a SCM, all the components, i.e. the sensor 12, the actuator 16 and the detection circuit 18 are integrated in one chip or a common substrate. In contrast, a MCM is a specialized electronic package where multiple integrated circuits, semiconductor dies or other modules are packaged in such a way as to facilitate their use as a single module. For example, the single chips are mould together to form a MCM. Hence, in case of a MCM, the single components, such as the sensor 12, the actuator 16 and the detection circuit 18 may be separate integrated circuits which are packaged in a common housing.

Embodiments of the present invention can realize a so-called sensor-life-control (SLC). Thereby, the physical quantity or parameter 14 which is measured or sensed by the sensor 12 can be changed by the actuator 16 in a controlled way during a sensor-life-control phase or test phase. This change of the physical parameter 14, e.g. from an average value, can then be recorded by the sensor 12. In case the recorded change is not as expected, a manipulation or a malfunction of the sensor 12 can be detected. In other words, the actuator 16 can be used for a self-stimulation of the sensor apparatus 10 during test phases.

Sensor systems can be used to automate controllers. Controllers are also increasingly used for critical applications, like, for example, control of cars, airplanes or robots. Guaranteeing integrity, also authenticity and privacy of the data and controlled processes of the sensor systems is of high importance here in order to recognize manipulations or malfunction of sensor elements and be able to react appropriately.

A manipulation of the sensor 12 cannot be ruled out completely. It is, for example, conceivable that a distance measuring device is manipulated by changing ambient measurement conditions and a car collides with a car driving in front, or a robot performs inappropriate actions caused by false sensor information.

When data are transferred in an encrypted manner between individual network elements of a controller network, such as, for example, sensor elements 12 on the one hand and a processor unit 17 on the other hand, this is no sufficient protection against manipulation of the data to be transferred. When data from sensors are manipulated directly at the respective sensor-chips (e.g. by changing ambient measurement conditions), as is, for example, possible by fault-provoking or fault attacks, the already manipulated data may be transferred from the sensor-chips in an encrypted manner without preventing manipulation success.

The above described embodiments could help to achieve more security in these applications. In order to guarantee the transfer of non-manipulated data or reduce the effect of transfer of data already manipulated, embodiments of the present invention provide detective countermeasures against manipulation of measurement conditions of the sensor 12. Hence, embodiments of the present invention may protect, for example, from an attack by changing the ambient conditions to be detected by the sensor 12, like, for example, a temperature or light. Further, embodiments of the present invention may also help to detect a malfunction of the sensor 12. This will be explained in more detail in the following.

As mentioned before, sensors are used in various critical applications. In all these critical applications it is essential to guarantee for a correct functionality of the sensor and/or to detect a manipulation of the measurement conditions, for example in case of an attack on a sensor chip in order to avoid unwanted actions to be performed responsive to the sensor output signals.

For example, alterations in a supply voltage of the data processor unit 17, like, for example by so-called spike attacks, can cause the data processor unit 17 to misinterpret or even skip program instructions or commands. A voltage sensor may be used to monitor the supply voltage. Hence, it might be important to guarantee for a correct functionality of the voltage sensor or to detect an intentional manipulation of the voltage measuring conditions of the voltage sensor.

Further, altering an external clock frequency fed to data processor unit 17 may result in incorrect reading and/or writing of data (the processor tries to read a value from a data bus before a memory has had the opportunity to output the value requested). In addition, altering the external clock frequency may result in skipping instructions or commands of the data processor unit 17, such that the data processor unit 17 will execute a command n+1 before the data processor unit 17 has finished executing the command n. Therefore it is important to guarantee for a correct functionality of a clock signal sensor or to detect a manipulation of the ambient measurement conditions of the clock frequency sensor.

Another error source for a data processor unit 17 may be a chip temperature falling outside a temperature range specified by a manufacturer in which the chip operates as intended. Hence, a temperature sensor being secure with respect to a recognition of manipulations and/or malfunctions of the temperature sensor might be advantageous.

Furthermore, due to photoelectrical effects, all the electrical circuits are light-sensitive. A current induced by photons in an electrical circuit can be used to provoke errors, should the electrical circuit be exposed to intense light for a short duration. A similar effect may, for example, be caused by irradiating a part of an electrical circuit by laser light. X-ray and ion radiation are examples of further error sources. Hence, secure light or radiation sensors according to embodiments of the present invention can be used to prevent such attacks.

In order to principally explain the functionality of embodiments of the present invention in further detail, let us consider the sensor 12 to be a light sensor or photo detector. For example, the light sensor 12 can be implemented by using photo cells, photo diodes, photo transistors, etc. The actuator 16 forms a counterpart of the light sensor 12. I.e., the actuator 16 is then, for example, a light source such as, for example, a light emitting diode (LED).

In secure applications as mentioned above, the light sensor 12 may be used, for example, for detecting the application of intense light to an electrical circuit. For that reason, the detection circuit 18 may be configured to output an indication in case that the physical quantity (light in this case) sensed by the sensor 12 exceeds a first predefined threshold value. Of course, other scenarios are conceivable, where it is important to output an indication in case the physical quantity 14 sensed by the sensor 12 underruns a first predefined threshold, for example a lower temperature or pressure limit.

If an attacker now wants to expose the processor unit 17 to intense light in order to provoke faults, he might want to destroy or fool the light sensor 12. For example, the attacker could apply a non-transparent or dark layer on a light-sensitive surface of the light sensor 12. In this case, the light sensor 12 would not be able to detect the intense light exceeding the first predefined threshold since the intransparent or light filtering layer on the light-sensitive surface of the light sensor 12 prevents the extensive light reaching the light-sensitive surface. In this case, an attack by means of intense light could not be detected by means of the light sensor 12. However, embodiments of the present invention additionally provide the actuator 16, which may be configured to manipulate the physical quantity 14 in direction towards the predefined first threshold. In the exemplary case described herein, the actuator 16 is a light source which can generate light with an intensity smaller than the first threshold, which represents an upper limit in this case. In case the first threshold represents a lower limit, the actuator 16 can generate a physical quantity still above the first threshold. I.e., in general the actuator 16 is configured to manipulate the physical quantity 14 in direction towards the predefined first threshold without reaching it, such that the indication of the physical quantity being out of an allowable range is not triggered.

Figure 2A:
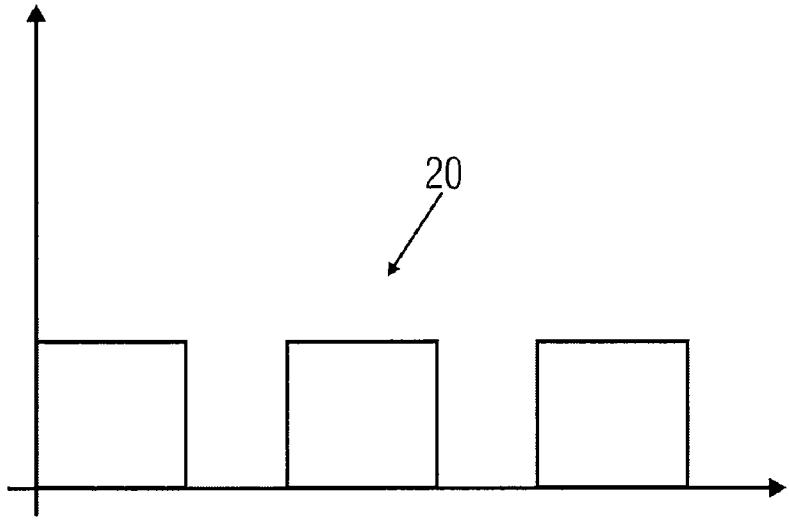
FIG. 2*a* shows a diagram of an actuator excitation signal versus time.

In the exemplary case the light source 16 is configured to manipulate a current or average intensity of light reaching the light sensor 12 in a predefined manner. That is, the light source 16 is configured to generate a predefined light pattern by, for example, turning the light source 16 on and off, as indicated in FIG. 2*a*. The light of predefined light pattern may be additive to other background light sensed by the light sensor 12.

FIG. 2*a* exemplarily shows a predefined test signal pattern 20 yielding the predefined light pattern. Of course the generation of the light pattern can be done in various ways, for example, intermittently, periodically or permanently.

Figure 2B:
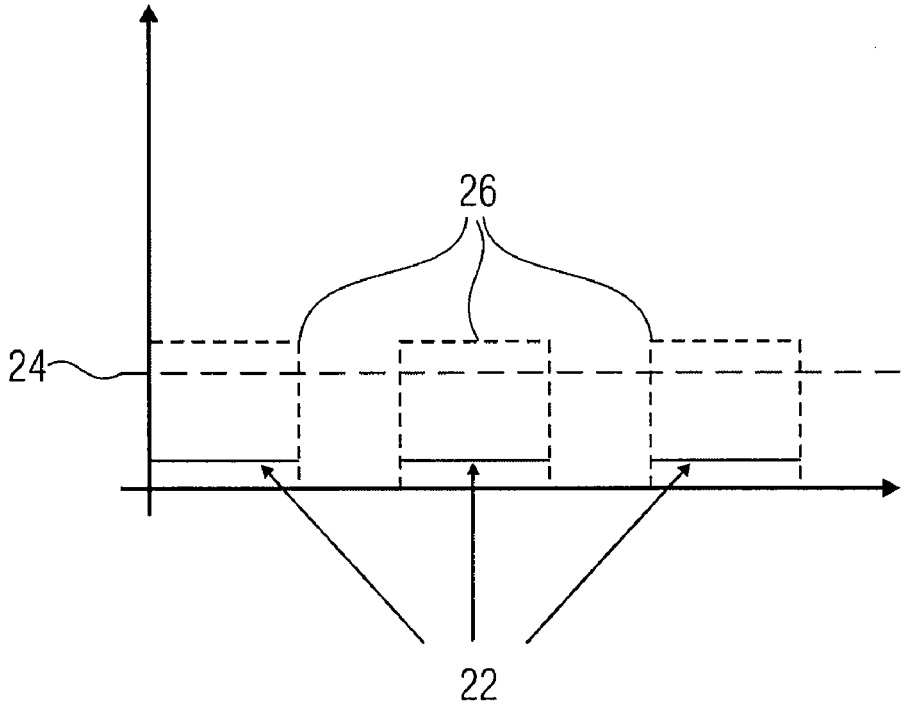
FIG. 2*b* shows a diagram of a sensor output signal versus time.

In any case, under normal conditions, the light sensor 12 will be able to sense the predefined light pattern of the light source 16 and deliver an expected sensor output signal 26 above a predefined second threshold 24, as indicated in FIG. 2*b*. The predefined second threshold 24 is dedicated to the predefined light pattern or the test signal and is hence smaller than the predefined first threshold dedicated to an upper limit for detecting a forbidden intense light pulse.

However, in the case described before, where the light-sensitive surface of the light sensor 12 is blinded, the predefined light pattern generated by the light source 16 will not be sensed or recognized by the light sensor 12 in a sufficient manner. Either the light sensor 12 will not sense anything at all or an amplitude of the sensor output signal reaching the detection circuit 18 will be too small, as indicated by reference numeral 22 in FIG. 2*b*. In case the sensor output signal of the sensor 12 underruns the second predefined threshold value 24, the detection circuit 18 outputs the alarm signal 19. As indicated before, there are various signal processing alternatives of determining whether the sensor output signal of the sensor 12 exceeds or underruns the second predefined threshold value 24, e.g. by means of a high-pass filter applied to the sensor output signal.

Hence, the detection circuit 18 may be configured to output the alarm signal 19 in case the physical quantity 14 sensed by the sensor 12 or a value based thereon lies in an interval extending from the predefined second threshold 24 into a first direction towards smaller values than the second threshold 24 reactive to the manipulation of the physical quantity 14 by the actuator 16.

The alarm signal 19 may exemplarily be a notification signal which is communicated to the outside such that, for example, a controller chip connected to the sensor apparatus 10 is notified about a potential attack or a malfunction of the sensor element 12. According to further embodiments of the present invention, the alarm signal 19 may also trigger a protective mechanism on the sensor apparatus 10 by, for example, deleting security-relevant data from a memory or interrupting a supply voltage.

In other embodiments the predefined second threshold 24 can be larger than the predefined first threshold dedicated to lower limit for detecting a forbidden physical quantity level. In case, if the sensor output signal of the sensor 12 then exceeds the second predefined threshold value 24, the detection circuit 18 outputs the alarm signal 19.

Hence, the detection circuit 18 may also be configured to output the alarm signal 19 in case the physical quantity 14 sensed by the sensor 12 or a value based thereon lies in an interval extending from the predefined second threshold 24 into a second direction towards larger values than the second threshold 24, i.e. opposed to the first direction, reactive to the manipulation of the physical quantity 14 by the actuator 16.

A sensor output signal similar to the sensor output signal 22 might be detected in case the sensor 12 does not function correctly. In this case, the alarm signal 19 is also triggered since the sensor output signal in response to the predefined light pattern of the light source 16 is below the second threshold 24. Therefore, it might not be possible to distinguish between an attack or a malfunction of the sensor 12. However, an attack as well as a malfunction is not desired and countermeasures have to be taken. This can be accomplished by the alarm signal 19.

A possibly detected sensor output signal in response to the manipulation signal 20 of the actuator 16 under normal conditions has the reference numeral 26 in FIG. 2*b*. In this case, the sensor 12 detects the light pulses of the light source 16 in an expected way since the sensor output signal 26 exceeds the given second threshold 24. In this case, no alarm signal is outputted by the detection circuit 18.

Although the inventive concept has exemplarily been described by means of a light sensor as sensor 16 and a light source as actuator 16, embodiments of the present invention are of course not limited to light sensors and light sources. A person skilled in the art will be able to apply the inventive concepts to sensors and actuator of other kinds. For example, according to a further embodiment, the actuator 16 could be a coil for the generation of a magnetic field as a physical quantity 14. In this case the coil 16 generates a predefined magnetic field or a certain sequence of magnetic fields, which have to be sensed or identified by a magnetic field sensor 12, which could be a Hall-sensor, for example. In case the sensed magnetic field diverges from an expected value or pattern, the detection circuit 18 may output the alarm signal 19 since a manipulation or a malfunction of the magnetic field sensor 12 is conceivable.

Figure 3:
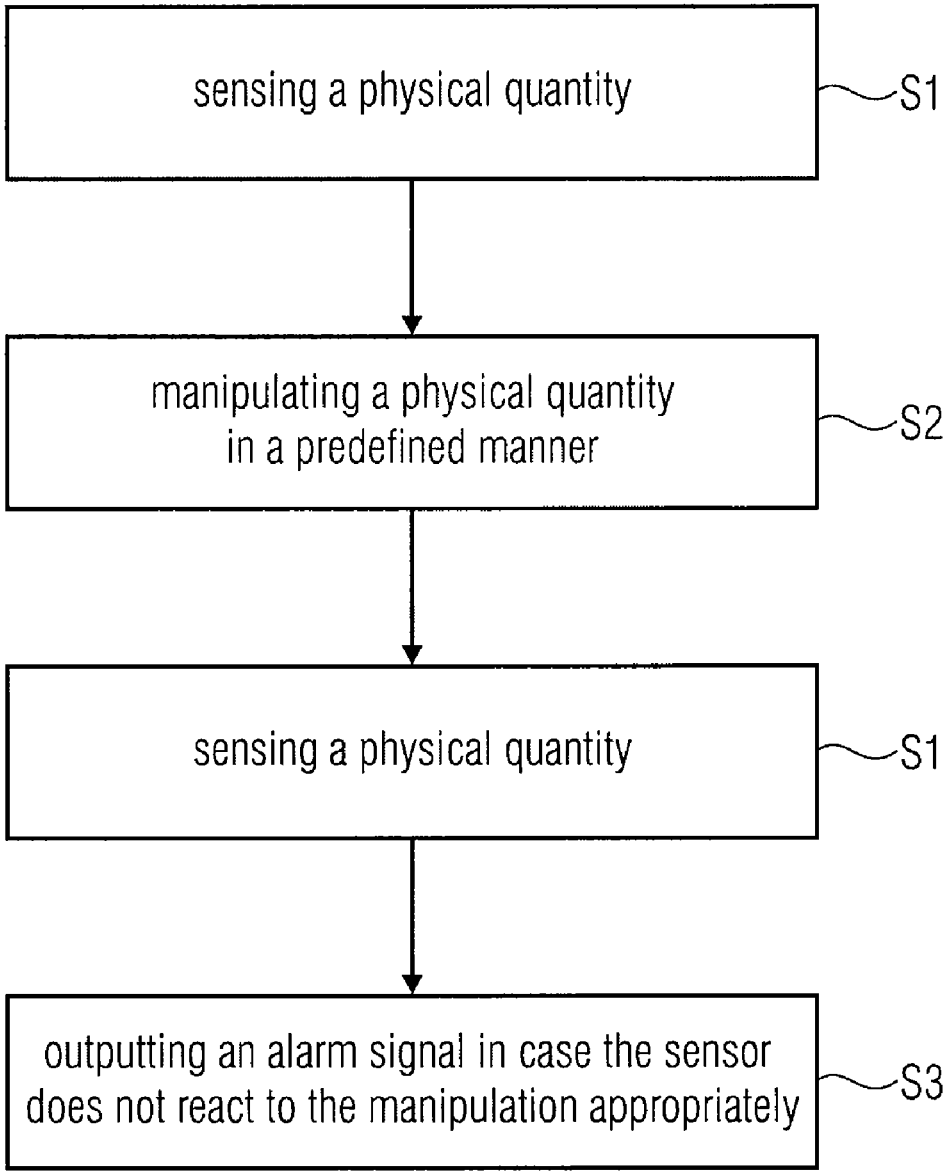
FIG. 3 shows a flowchart of a method for secure sensing physical quantity according to an embodiment of the present invention.

To summarize, embodiments of the present invention provide a concept or method for secure sensing of a physical quantity, which is depicted in a schematic flowchart shown in FIG. 3.

The method comprises a step S1 of manipulating a physical quantity in a predefined manner by means of the actuator 16. In a next step S2, which can be carried out temporarily in parallel to the first step S1, the manipulated physical quantity is sensed by means of the sensor 12. In a further step S3, the alarm signal 19 is outputted in case the sensor does not react to the manipulation of the physical quantity 14 in an expected way. In other words, the alarm signal is outputted in case the sensor 12 delivers a sensor output signal which exceeds or underruns the second threshold value.

In particular it is pointed out that, depending on the circumstances, the inventive method for secure sensing of a physical quantity may be implemented in hardware or in software. The implementation may be done on a digital storage medium, particularly a disk, DVD or a CD with electronically readable control signals, which may cooperate with a programmable computer system so that the method is executed. In general, the invention thus also consists in a computer program product with a program code stored on a machine-readable carrier for performing the inventive method when the computer program product runs on a computer. In other words, the invention may thus be realized as a computer program with a program code for performing the method when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus, comprising:

a sensor configured to sense a physical quantity;

an actuator configured to manipulate the physical quantity in a predefined manner; and a detection circuit configured to output an alarm signal in case the sensor does not react to the manipulation of the physical quantity in an expected way.

2. The apparatus according to claim 1, wherein the detection circuit is configured to output the alarm signal in case the physical quantity sensed by the sensor or a value based thereon lies in an interval extending from a predefined threshold into one of a first direction and a second direction opposed to the first direction reactive to the manipulation.

3. The apparatus according to claim 2, wherein the actuator is configured to manipulate the physical quantity into one of the first and second direction.

4. The apparatus according to claim 1, wherein the sensor is an electromechanical sensor.

5. The apparatus according to claim 1, wherein the actuator is an electromechanical actuator.

6. The apparatus according to claim 1, wherein the sensor is a radiation sensor, a magnetic field sensor, a temperature sensor, pressure sensor or optical sensor.

7. The apparatus according to claim 1, wherein the actuator is a electromechanical system, a light-emitting device, a piezoelectric device or a micro-fluidic device.

8. The apparatus according to claim 1, wherein the sensor, the actuator and the detection circuit are commonly integrated in a multi-chip module (MCM).

9. The apparatus according to claim 1, wherein the sensor, the actuator and the detection circuit are commonly integrated in a single-chip module (SCM).

10. An apparatus, comprising:

means for sensing a physical quantity;

means for manipulating the physical quantity in a predefined manner; and means for generating an alarm signal in case the sensor does not react to the manipulation of the physical quantity in an expected way.

11. The apparatus according to claim 10, wherein the means for generating outputs the alarm signal in case the physical quantity or a value based thereon lies in an interval extending from a predefined threshold into one of a first direction and a second direction opposed to the first direction reactive to the manipulation.

12. The apparatus according to claim 11, wherein the means for manipulating manipulates the physical quantity into one of the first and second direction.

13. The apparatus according to claim 10, wherein the means for sensing comprises an electromechanical sensor.

14. The apparatus according to claim 10, wherein the means for manipulating comprises an electromechanical actuator.

15. A method for secure sensing, comprising:

manipulating a physical quantity in a predefined manner;

sensing the physical quantity; and generating an alarm signal in case the sensor does not react to the manipulation of the physical quantity in an expected way.

16. A computer readable medium having stored thereon a computer program comprising a program code for performing the method for secure sensing according to claim 15, when the computer program is running on a computer and/or microcontroller.

* * * * *